US006124019A

United States Patent [19]

Mense

[11] Patent Number: 6,124,019

[45] Date of Patent: Sep. 26, 2000

[54] UPHOLSTERY COMPONENT WITH SECURED COVER AND PROCESS FOR ITS PRODUCTION

[75] Inventor: Hubert Mense, Prichsenstadt/ Ot Kirschönbach, Germany

[73] Assignee: Fa. F.s. Fehrer GmbH & Co. KG, Kitzingen, Germany

[21] Appl. No.: 09/068,725

[22] PCT Filed: Oct. 30, 1996

[86] PCT No.: PCT/DE96/02082

§ 371 Date: Jun. 5, 1998

§ 102(e) Date: Jun. 5, 1998

[87] PCT Pub. No.: WO97/17871

PCT Pub. Date: May 22, 1997

[30] Foreign Application Priority Data

Nov. 13, 1995 [DE] Germany ..... 195 42 269

[51] Int. Cl.[7] ..... A47C 31/02

[52] U.S. Cl. ..... 428/122; 428/159; 428/163; 428/90; 428/99; 428/134; 428/139; 297/228.13

[58] Field of Search ..... 428/122, 159; 297/228.13

[56] References Cited

U.S. PATENT DOCUMENTS

| | | | |
|---|---|---|---|
| 3,794,378 | 2/1974 | Haslam et al. | 297/219 |
| 4,582,739 | 4/1986 | Givens | 428/83 |
| 4,698,253 | 10/1987 | Osawa | 428/159 |
| 4,835,029 | 5/1989 | Thebaud et al. | 428/68 |
| 5,543,213 | 8/1996 | Duvenkamp | 428/230 |
| 5,723,197 | 3/1998 | Grund et al. | 428/122 |
| 5,806,925 | 9/1998 | Hanley | 297/229 |
| 5,820,213 | 10/1998 | Severinski | 297/218.5 |
| 5,820,222 | 10/1998 | DeFilippo | 297/452.58 |

FOREIGN PATENT DOCUMENTS

| | | |
|---|---|---|
| 0 252 783 | 1/1988 | European Pat. Off. . |
| 39 06 200A1 | 9/1989 | Germany . |
| WO 90/15556 | 12/1990 | WIPO . |

OTHER PUBLICATIONS

English Translation of the International Preliminary Examination Report dated Feb. 20, 1998.

*Primary Examiner*—Ellen M. McAvoy
*Attorney, Agent, or Firm*—Darby & Darby

[57] ABSTRACT

The invention proposes an upholstery element with a covering which covers a core of an elastic material, preferably of a foamed plastic, and is fastened to this core by an anchorage element which is enclosed by the core, wherein the surface of the core (1) comprises a groove (4) which widens inwards, one edge of a material strip (7) is fixed to the inside of the covering (2), the opposite edge of which strip is provided with a dimensionally stable body (3), the body (3) is introduced into the groove (4), and the maximum diameter of the body (3) is located in the groove (4) and is greater than the minimum diameter of the groove (4), and a method for the production thereof.

12 Claims, 2 Drawing Sheets

FIG. 1
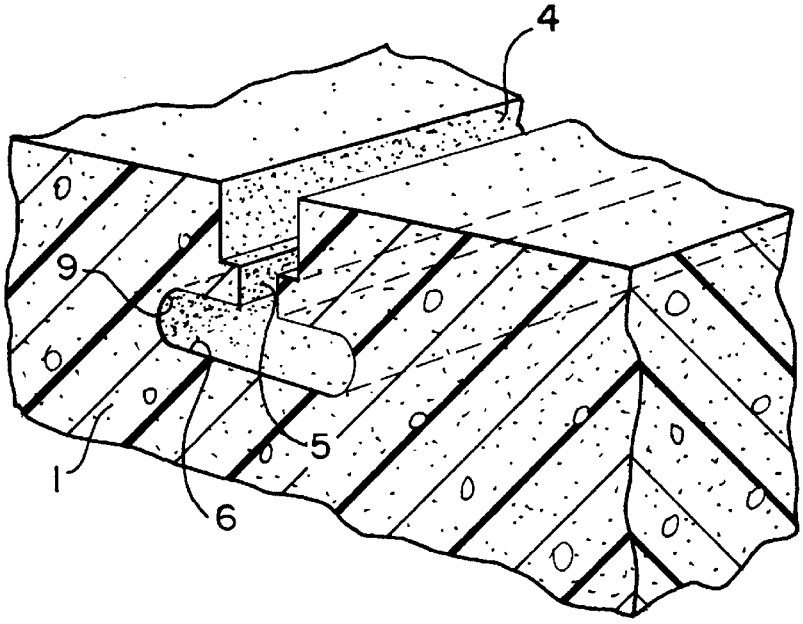
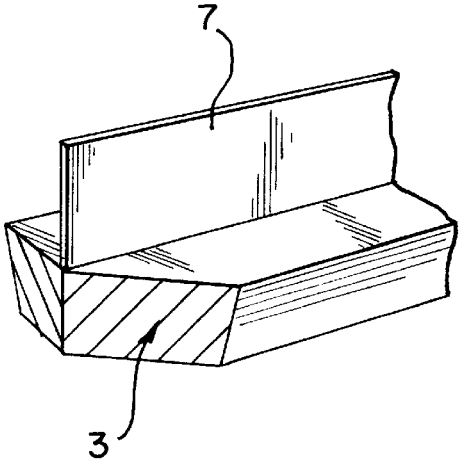
FIG. 3
FIG. 2
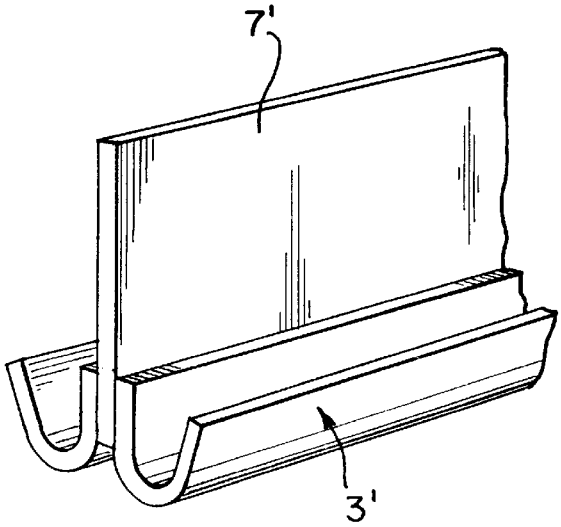

UPHOLSTERY COMPONENT WITH SECURED COVER AND PROCESS FOR ITS PRODUCTION

FIELD OF THE INVENTION

The invention relates to an Upholstery element with a covering which covers a core of an elastic material, preferably of a foamed plastic, and is fastened to this core by an anchorage element which is enclosed by the core, and to a method for the production thereof.

BACKGROUND OF THE INVENTION

Upholstery elements, for example for the interior furnishing of motor vehicles, generally consist of an elastic core whose surface is completely or partly covered by a covering, for instance of cloth, leather or similar, for protective and aesthetic purposes. Foamed plastics, preferably polyurethane, are in particular used as the core material, occasionally also vegetable or animal fibres bonded together. In order to ensure that the covering holds firmly to the core, anchorage elements enclosed by the core material are commonly used in the prior art to distribute stresses occurring due to force over a large area. The utility model DE 295 06 306 discloses an example of an anchorage element in the form of a profile which can be foamed into a core. The particular advantage of the described anchorage element lies in the fact that, with the exception of a network of fibres, it consists of polyurethane, so that it is far easier to recycle the upholstery material as a result of using a uniform material and avoiding metal parts. The anchorage elements are joined to the covering by fastening means, for example hooks, which pass through the foamed plastic which is frequently provided with recesses for this purpose.

The anchorage elements known in the prior art entail high expenditure when producing the upholstery, with the clamping of the covering and the anchorage elements and the positioning thereof in the foaming mould in particular being labour-intensive. Moreover, there is a permanent join between the core of the upholstery and the covering, so that it becomes far more difficult to replace the latter should it wear or for aesthetic reasons.

OBJECT OF THE INVENTION

Against this background, the object of the invention is to develop an upholstery element in which the expenditure for anchoring the covering is reduced and the latter can be replaced without undoing permanent joins.

This object is achieved according to the invention in that the surface of the core comprises a groove which widens inwards, one edge of a material strip is fixed to the inside of the covering, the opposite edge of which strip is provided with a dimensionally stable body, the body is introduced into the groove, and the maximum diameter of the body is located in the groove and is greater than the minimum diameter of the groove.

DETAILED DESCRIPTION OF THE INVENTION

The surface of the core of the proposed upholstery element comprises a groove in the form of a hollow section which widens at the bottom, i.e. towards the interior of the core. A preferably profiled body is located in the groove, the maximum diameter of which body is disposed in the groove and is greater than the minimum diameter of the latter. The narrowest region of the groove is appropriately its opening.

As a result, the dimensionally stable body can only be positioned in the groove and withdrawn from the latter by deforming the elastic core material. The spring force exerted by the core material in this case makes the body sit firmly in the groove. Dimensional stability of the body is only required for sufficient anchorage, so that its inherent elasticity can correspond perfectly well to that of the core material.

The join between the covering and the body is effected by a material strip, which may also be a component of the latter. Appropriate material strips are those which consist of a flexible material, for example netting or a woven fabric, which are fastened at the edge to the inside of the covering, e.g. stitched thereto. The groove is preferably filled by a single body in the form of a profile, with the material strip being joined to the body and the covering along its longitudinal sides. It is alternatively possible to introduce a plurality of bodies into one groove, these in each case being fixed to the covering by individual strips.

The covering is anchored to the core of the upholstery element such that the core is firstly made with the groove by means of a common production process. The groove is generally formed by an appropriate elevation in the mould, for example when injection moulding. Because it is produced during the conventional core forming process, it is made without any additional expenditure. On the other hand, the alternative possibility of milling or cutting out the groove, which exists in principle, is generally out of the question for cost reasons. The body and the covering are joined by the material strip by stitching the latter to both of these, for example, independently of the production of the core with the groove. The type of join may vary in different body and material strip constructions, as explained in the following. The essential advantage in comparison with the prior art lies in the fact that the join to be produced between the body and the inside of the covering is freely accessible for working, whereas the fastening operation has until now had to take place in a confined space between the covering and the core of the upholstery. Finally, the body is pressed into the groove, thus producing a join between the core and the covering which can be stressed yet undone by pulling sufficiently. It would be possible to pull or press the edges of the groove apart to facilitate the pressing-in process.

The proposed upholstery element can be produced tar more easily than is possible in the prior art. It is therefore unnecessary to stock prefabricated anchorage elements or position them in the foaming mould. As bent, angular or intersecting grooves are also possible, any desired seam structures can be produced on the upholstery surface. There is no need for any complex clamping between the covering and the anchorage element. The covering can also be easily detached from the core of the upholstery in order to replace it if worn, for example. In addition, however, because of the low expenditure involved in detaching and fixing the covering, which is also possible for laymen and without a tool, it would seem obvious, for example in the case of a motor vehicle, to replace the coverings for aesthetic reasons or to adapt to the season. Moreover, in contrast to metal anchorage elements, which are used in many cases, there are further advantages relating to the weight of the upholstery, which is especially crucial when used in a motor vehicle, and in the recycling of the upholstery material. Metal-free upholstery can in particular be easily disintegrated or chemically dissolved. The fastening according to the invention of the covering can also be used with cores of different materials, for example with a foamed plastic layer comprising spring means underneath, if there is an outer region of an elastic and homogeneous material of a depth sufficient to introduce a groove.

In an advantageous development of the invention the material strip is a fleece which consists, for example, of polypropylene fibres and can easily be fastened to the covering by sewing. A material strip whose side which is distant from the covering consists of two sub-strips extending next to one another is also preferred. The cross section of the material strip is therefore approximately in the form of a "T" or "Y", the base of which is fastened to the covering. The end division into two sub-strips improves and extends the possibilities for fixing a body.

Suitable groove cross sections are, for example, wedge- or T-shaped, with the vertical line of the "T" preferably being directed perpendicularly to the surface of the core. The opening or narrowest point of the groove may be very narrow and in the extreme case represent a slit in the core surface.

In particular when the core of the upholstery is made by foam-filling a mould, it is difficult to remove from the latter, as the elevation on the inside of the mould which forms the groove is fixed in the same way as a body for fastening the covering in the groove. Problems arise in this respect especially due to the edges of the mould, which hook into the walls of the groove. It is therefore advisable for the groove to have rounded edges in cross section which facilitate the removal of the core.

The body preferably has material properties similar to those of the core, so that the user of the upholstery does not find it unpleasant to touch. This also prevents the groove and the body from damaging one another. The body therefore consists of a foamed plastic which can be bonded to the material strip, for example. When using a porous material strip, such as netting or a fleece, a strong join which can be stressed can also be produced by foaming round at the edge. In this case a particularly strong join can be achieved if the material strip is divided at the edge into sub-strips.

As a result of being formed in a foaming mould, foam mouldings usually have a closed-cell, smooth surface structure, so that two mouldings slide on one another with comparatively little friction. In order to improve the adhesion of the body in the groove and thus fasten the covering to the upholstery element more strongly, the use of an open-cell foamed plastic as can be produced, for example, by cutting off the surface or with an extruder is proposed. The edges of the open foam cells act like hooks and are pressed slightly into the smooth surface of the groove, as the stress is restricted to narrow webs between the cells. The advantageous consequence is a substantial increase in the static friction between the body and the groove and thus a firm seat. Production in an extruder also enables the body to be continuously produced in an advantageous and inexpensive manner.

An alternative body is an integral component of the material strip and can be produced, for example, by stabilising the dimensions of the material of a fleece. In addition to impregnating, for example with an adhesive or resin, a thermal treatment of the fleece material which results in hardening or superficial fusion of the fibres is in particular suitable for this purpose. In the latter case the fleece is compressed, with superimposed fibres being strongly joined together, thus producing a dimensionally stable body which can be fixed in the groove. Although the entire material strip can be stabilised in terms of dimensions, i.e. also in the region between the body and the covering, this is not generally necessary.

A body which widens in the direction of the groove opening, i.e. in the direction in which the groove narrows, is of advantage. The body is bounded on the outside by a rim at its widest point. A suitable profile is one with a trapezoidal cross section, for example, with the shorter of the parallel trapezium sides being directed towards the bottom of the groove. When a tensile stress is exerted through the material strip the rim of the body presses into the wall of the grove and thus fixes the body in this position. The cover fastening can in this way be greatly improved, particularly in the case of grooves with a rounded cross section. The only requirement for hooking into the groove wall is for the body to widen relative to the cross section of the groove. If the groove narrows continuously towards the opening, it is therefore also possible for a body with a rectangular or T-shaped cross section to hook into the wall In order to produce a join which can be highly stressed, the body has the cross section of a barb, i.e. points or edges directed at an acute angle towards the opening of the groove. In order to prevent the core from suffering damage during withdrawal to change the cover, a profiled body of a constant cross section is preferred in this case. Also appropriate are elastic hooks which can be compressed to be positioned in the groove. A suitable double hook can advantageously be produced in particular by stabilizing the dimensions of a fleece divided into two sub-strips at the edge. Any desired transitions between a bulky body only comprising hooks at the surface and a body formed as a hook are possible. For example, a wedge of polyurethane or polypropylene can be introduced into the apex of a double hook.

BRIEF DESCRIPTION OF THE DRAWINGS

Further details, features and advantages of the invention will emerge from the following description, in which embodiments of the invention are explained in detail in the light of the drawings, which are elementary representations and in which FIG. 1 is a cross section through an upholstery element according to the invention

FIG. 2 is a view of an anchorage element

FIG. 3 is a view of an alternative anchorage element.

FIG. 1 reproduces the cross section through an upholstery element consisting of a core (1), preferably of a foamed plastic such as polyurethane, with a covering (2) on its surface. The join between the core (1) and the covering (2) is effected by a body (3), which it introduced into a groove (4) in the surface of the core (1). The groove (4) widens in cross section from the opening (5) towards the bottom (6), so that the body (3), for example a profile of cut foam, the maximum diameter of which corresponds to the bottom region of the groove (4), is fixed therein. However, because the core (1) and possibly the body (3) consist(s) of an elastic material, introduction and withdrawal remain possible by exerting sufficiently high forces or bending open the groove (4). A material strip (7), e.g. a polypropylene fleece, which is stitched or sewn on at a seam (8) of the covering (2), serves as a join between the covering (2) and the body (3). The opposite side of the material strip (7) consists of two sub-strips (9), which are enclosed by the foamed plastic of the body (3) and provide a fastening which can be stressed.

FIG. 2 shows an alternative construction (3') of the body (3) in the form of a profile with a double-hooked cross section.

In FIG. 3 the body is shown co-operating with the core (1) or groove (4). As a result of being pressed into the wall of the groove (4), the edge hooks (10) of the body (3) produce bulges (11), so that the covering (2) is held firmly even in the case of a rimless groove (4) with rounded parts (12). A wedge (13) between the two hooks (10) helps to make the body (3) dimensionally stable.

Figure 1A:
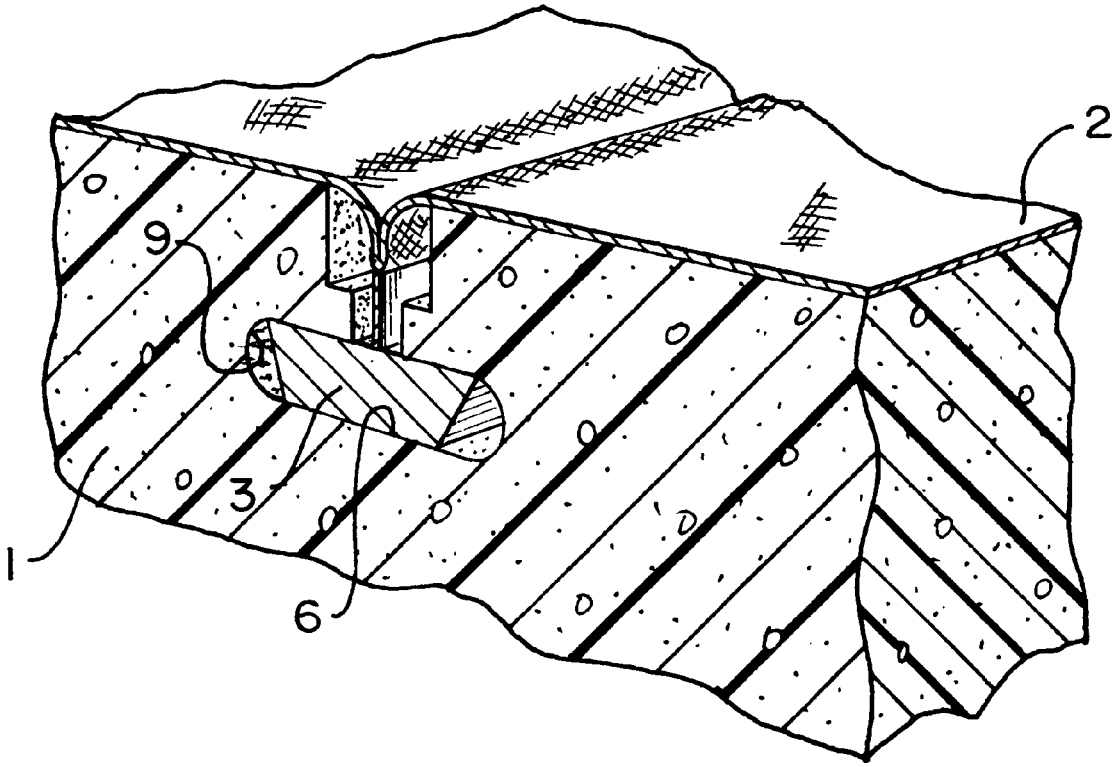
FIG. 1*a* is a cross section though an upholstery element including anchorage element.

The result is thus an anchorage element with which a covering can be easily and detachably fastened to the core of the upholstery without diminishing recycling possibilities.

What is claimed is:

1. An upholstery element with a covering which covers a core of an elastic material and is fastened to the core by an anchorage element which is enclosed by the core, wherein (a) the core includes a surface comprising a groove which widens inwardly;

(b) one edge of a material strip is fixed to the inside of the covering, the opposite edge of the strip is provided with a dimensionally stable body;

(c) the body is introduced into the groove; and (d) the maximum diameter of the body is located in the groove and is greater than the minimum diameter of the groove.

2. An element according to claim 1, wherein the material strip is fleece.

3. An element according to claim 1 wherein the edge of the material strip which is distant from the covering consists of two sub-strips extending parallel to one another.

4. An element according to claim 1, wherein the groove has a T- or wedge-shaped cross section.

5. An element according to claim 1, wherein the groove has a cross section with rounded edges.

6. An element according to claim 1, wherein the body consists of a foamed plastic.

7. An element according to claim 6, wherein the surface of the body has open cells.

8. An element according to claim 2, wherein the body consists of the dimensionally stabilised material of the fleece.

9. An element according to claim 1, wherein the body widens in the direction of the opening relative to the groove and has a rim at its widest point.

10. An element according to claim 1, wherein the body comprises on the outside hooks whose points bear against the lateral wall of the groove at an angle towards the opening of said groove.

11. A method for producing an upholstery element according to claim 1, comprising the steps of (a) producing the core with the groove as a moulding;

(b) joining the body and the covering by the material strip and (c) pressing the body into the groove.

12. An element according to claim 1, wherein the elastic material is a foamed plastic.

* * * * *